US006364376B1

(12) United States Patent
Spargo

(10) Patent No.: US 6,364,376 B1
(45) Date of Patent: Apr. 2, 2002

(54) APPLIANCE DOOR LATCH ASSEMBLY

(75) Inventor: Thomas W Spargo, Terryville, CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/606,085

(22) Filed: Jun. 29, 2000

(51) Int. Cl.[7] ..... E05C 19/10
(52) U.S. Cl. ..... 292/97; 292/DIG. 69
(58) Field of Search ..... 292/226, DIG. 69, 292/229, DIG. 71, 126, 129, 223, 97

(56) References Cited

U.S. PATENT DOCUMENTS

| | | | | |
|---|---|---|---|---|
| 3,313,918 A | | 4/1967 | Barber | |
| 3,325,200 A | | 6/1967 | Fowler | |
| 3,367,697 A | * | 2/1968 | Fox, Sr. | 292/DIG. 69 |
| 3,406,677 A | | 10/1968 | Anderson | |
| 3,409,320 A | * | 11/1968 | Eckerle | 292/DIG. 69 |
| 3,438,666 A | * | 4/1969 | Erickson | 292/DIG. 69 |
| 3,642,313 A | * | 2/1972 | Anderson | 292/DIG. 69 |
| 3,750,643 A | * | 8/1973 | Fowler et al. | 292/DIG. 69 |
| 3,815,942 A | * | 6/1974 | White | 292/DIG. 69 |
| 4,013,312 A | | 3/1977 | DeWeese | |
| 4,186,287 A | * | 1/1980 | Scott | |
| 4,861,078 A | | 8/1989 | Munoz | |
| 4,862,870 A | | 9/1989 | Fox | |
| 5,456,243 A | | 10/1995 | Jones | |

* cited by examiner

*Primary Examiner*—Brian L. Johnson
*Assistant Examiner*—Bryan Fischmann
(74) *Attorney, Agent, or Firm*—Pillsbury Winthrop LLP

(57) ABSTRACT

A latch assembly for manually releasably latching an appliance door in a closed position capable of being manually moved between an open position and a closed position features a frame structure constructed and arranged to be fixed with respect to an appliance structure to which the appliance door movably mounts at a position adjacent the appliance door. A handle structure is connected to the frame structure for pivotal movement about a first pivotal axis between door releasing and door latching positions. A latching structure is connected to the handle structure for pivotal movement with respect thereto about a spaced second pivotal axis between an inoperative position, which allows the appliance door to be manually moved between the open and closed positions thereof and an operative position, which latches the appliance door in the closed position thereof. An overcenter spring system is constructed and arranged to bias the latching structure into the inoperative position thereof when the handle structure is in the door releasing position thereof and to releasably retain the handle structure in the door releasing position thereof. Furthermore, the overcenter spring system is constructed and arranged to bias the latching structure into the operative position thereof when the handle structure is moved from the door releasing position thereof into the door latching position thereof with the appliance door in the closed position thereof and to releasably retain the handle structure in the door latching position thereof.

16 Claims, 6 Drawing Sheets

APPLIANCE DOOR LATCH ASSEMBLY

FIELD OF THE INVENTION

This invention relates to appliance door latches more particularly appliance door latches used during high temperature cleaning cycles such as self-cleaning ovens or dishwashers.

BACKGROUND OF THE INVENTION

Many types of appliance door latch assemblies are known in the art. Conventional appliance door latch assemblies typically include a frame structure fixed to an appliance, in which the frame structure carries a handle structure and a latching structure, thus the latching structure latches the appliance door in a closed position in response to movement of the handle structure. Examples are disclosed in U.S. Pat. Nos. 3,325,200 and 4,861,078.

There always exists a need in the art to make an appliance door latch assembly, which is more cost effective.

SUMMARY OF THE INVENTION

It is an object of the present invention to provide an appliance latch assembly that meets the need described above. In accordance with the principles of the present invention, this objective is accomplished by providing a latch assembly for manually releasably latching an appliance door in a closed position capable of being manually moved between an open position and a closed position. The latch assembly comprises a frame structure constructed and arranged to be fixed with respect to an appliance structure to which the appliance door movably mounts at a position adjacent the appliance door. A handle structure is connected to the frame structure for pivotal movement about a first pivotal axis between door releasing and door latching positions. A latching structure is connected to the handle structure for pivotal movement with respect thereto about a spaced second pivotal axis between an inoperative position, which allows the appliance door to be manually moved between the open and closed positions thereof and an operative position, which latches the appliance door in the closed position thereof. An overcenter spring system is constructed and arranged to bias the latching structure toward and into the inoperative position thereto when the handle structure is in the door releasing position thereof and to releasably retain the handle structure in the door releasing position thereof. Furthermore, the overcenter spring system is constructed and arranged to bias the latching structure into the operative position thereof when the handle structure is moved from the door releasing position thereof into the door latching position thereof with the appliance door in the closed position thereof and to releasably retain the handle structure in the door latching position thereof.

DETAILED DESCRIPTION OF THE INVENTION

Figure 1:
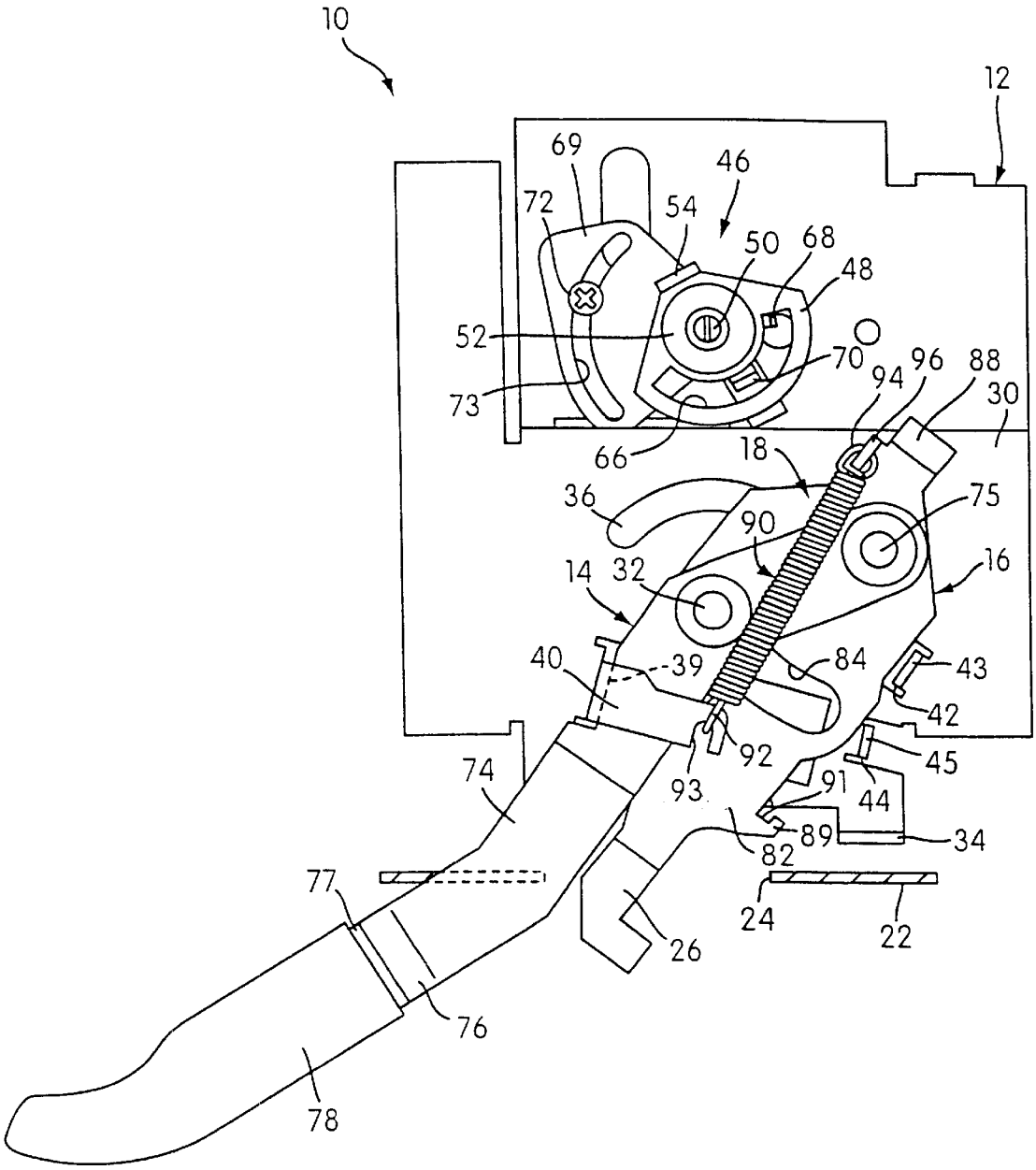
FIG. 1 is a top plan view of the preferred embodiment embodying the principles of the present invention in the door releasing position.

Referring now, more particularly to the drawings, there is shown in FIG. 1 thereof a preferred embodiment of an appliance door latch assembly of the present invention in an inoperative position. The door latch assembly, generally indicated at 10, is in the form of an appliance door latch embodying the principles of the present invention for manually releasably latching an appliance door 22 in a closed position. The appliance door 22 can be manually moved between an open position and a closed position. The latch assembly 10 comprises a frame structure, generally indicated at 12, and a handle structure, generally indicated at 14, with the handle structure 14 being mounted on the frame structure 12 for manual movement. A latching structure, generally indicated at 16, is pivotally mounted on the handle structure 14 and is biased into inoperative and operative positions by an overcenter spring system, generally indicated at 18.

The frame structure 12 is constructed and arranged to be fixed with respect to an appliance structure (not shown). The appliance door 22 is movably mounted to the appliance structure at a position adjacent to the appliance door 22. The appliance door 22 includes a latch receiving structure 24 for receivably engaging the latching structure 16 while the appliance door 22 is in its closed position.

The handle structure 14 is mounted on the frame structure 12 for pivotal movement about a first pivotal axis between a door releasing position and a door latching position.

The latching structure 16 is mounted on the handle structure 14 for pivotal movement with respect thereto about a second pivotal axis. The second pivotal axis is disposed in spaced from relation to the first pivotal axis. The latching structure 16 moves between an inoperative position wherein the appliance door 22 is allowed to be manually moved between open and closed positions and an operative position which latches the appliance door 22 in the closed position.

The overcenter spring system 18 is constructed and arranged to (1) bias the latching structure 16 into the inoperative position thereof when the handle structure is in the door releasing position thereof and to releasably retain the handle structure 14 in the door releasing position and (2) bias the latching structure 16 into the operative position thereof when the handle structure 14 is moved from the door releasing position into the door latching position thereof with the appliance door 22 in the closed position and to releasably retain the handle structure 14 in the door latching position.

The latching structure 16 includes a latch portion 26 configured and positioned to engage a latch receiving structure 24 of the appliance door 22 at the end of a first portion of the movement of the handle structure 16 from the door releasing position to the door latching position with the appliance door 22 in the closed position. The engagement between the latch portion 26 and the latch receiving structure 24 causes a relative pivotal movement of the latching structure 16 about the second pivotal axis away from the inoperative position and against the bias of the overcenter spring system 18 during the remaining portion of the movement of the handle structure 16 from the door releasing position to the door latching position. In this remaining portion of the movement, the overcenter spring system 18 is operable to bias the latching structure 16 into the operative position.

As best illustrated in FIGS. 1–4 and 6, the frame structure 12 includes a sheet metal frame member 30 having a pivot pin 32 fixed thereto and extending outwardly therefrom on which the handle structure 14 is pivotally mounted to define the first pivotal axis. A pair of protrusions 34 upwardly extends from the sheet metal frame member 30 with each protrusion 34 being configured and positioned to retain a fastener (not shown) therethrough. The fasteners are used to fix the frame member 30 to the appliance structure. The sheet metal frame member 30 has a pair of elongated raised portions 36, as best shown in FIGS. 1–6. FIG. 5 shows the pair of elongated raised portions 36 from the opposite side of the frame member 30 as being disposed on opposite sides of the pivot pin 32. The pair of elongated raised portions are configured and positioned to be engaged by the latching structure 16 and to stablely guide the same during movements thereof with respect to the sheet metal frame member 30.

The sheet metal frame member 30 further includes a plurality of stop surfaces configured and positioned with respect to the latching structure 16 to prevent further movement of the handle structure 14 when manually moved from the door releasing position toward the door latching position by engaging the handle structure 14. The appliance door 22 is shown in the closed position in FIGS. 1–3. With the appliance door 22 in the closed position, the handle structure 14 engages a first stop surface 39 on a side wall of the first stop structure 40 when moved into the door releasing position. The handle structure engages a second stop surface 42 of an upward bent tab 43 extending from the frame member 30 when moved into the door latching position. As shown in FIGS. 4 and 5, the appliance door 22 is away from the closed position. With the appliance door 22 away from the closed position, the latching structure 16 is carried therewith the handle structure 14 to a stop position, as best shown in FIG. 4. In this position, the handle structure 14 engages a third stop surface 44 on an upward bent tab 45 extending from the frame member 30.

The sheet metal frame member 30 carries a heat activated locking assembly 46 to prevent the appliance door 22 from opening during a high temperature cleaning cycle, as such with a self-cleaning oven or dishwasher. The heat activated locking assembly 46 includes a heat sensitive actuator 48 constructed and arranged to move into the path of movement of the latching structure 16 so to engage the latching structure 16 when the heat sensitive actuator 48 measures a predetermined relatively high temperature condition within the appliance. The heat sensitive actuator 48 is further constructed and arranged to move out of the path of movement of the latching structure 16 so not to engage the latching structure 16 when the heat sensitive actuator 48 measures a predetermined lower temperature condition within the appliance.

Figure 2:
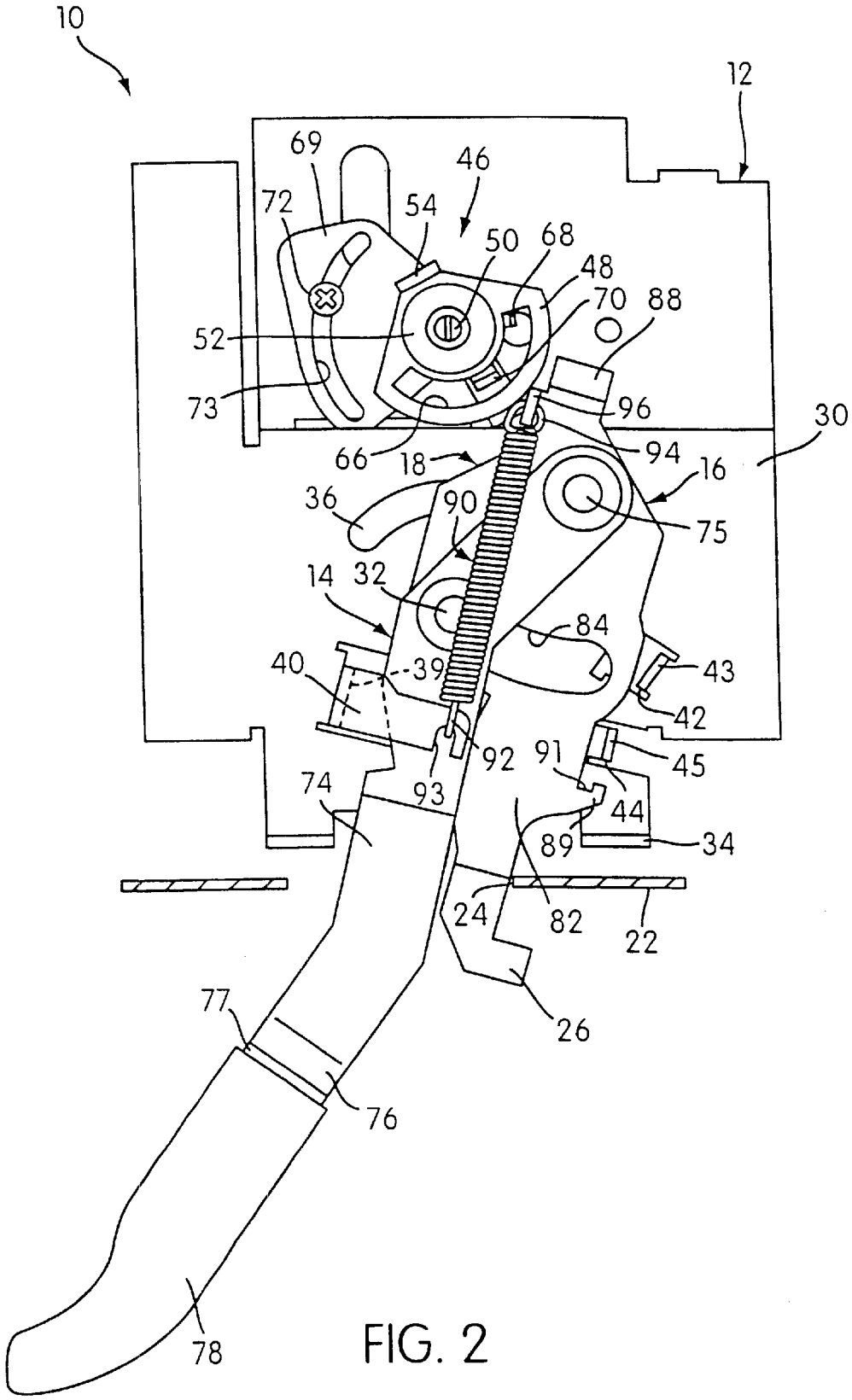
FIG. 2 is a top plan view similar to FIG. 1 showing of the latching member of the latching structure of the preferred embodiment initially engaging the door latch structure.
Figure 3:
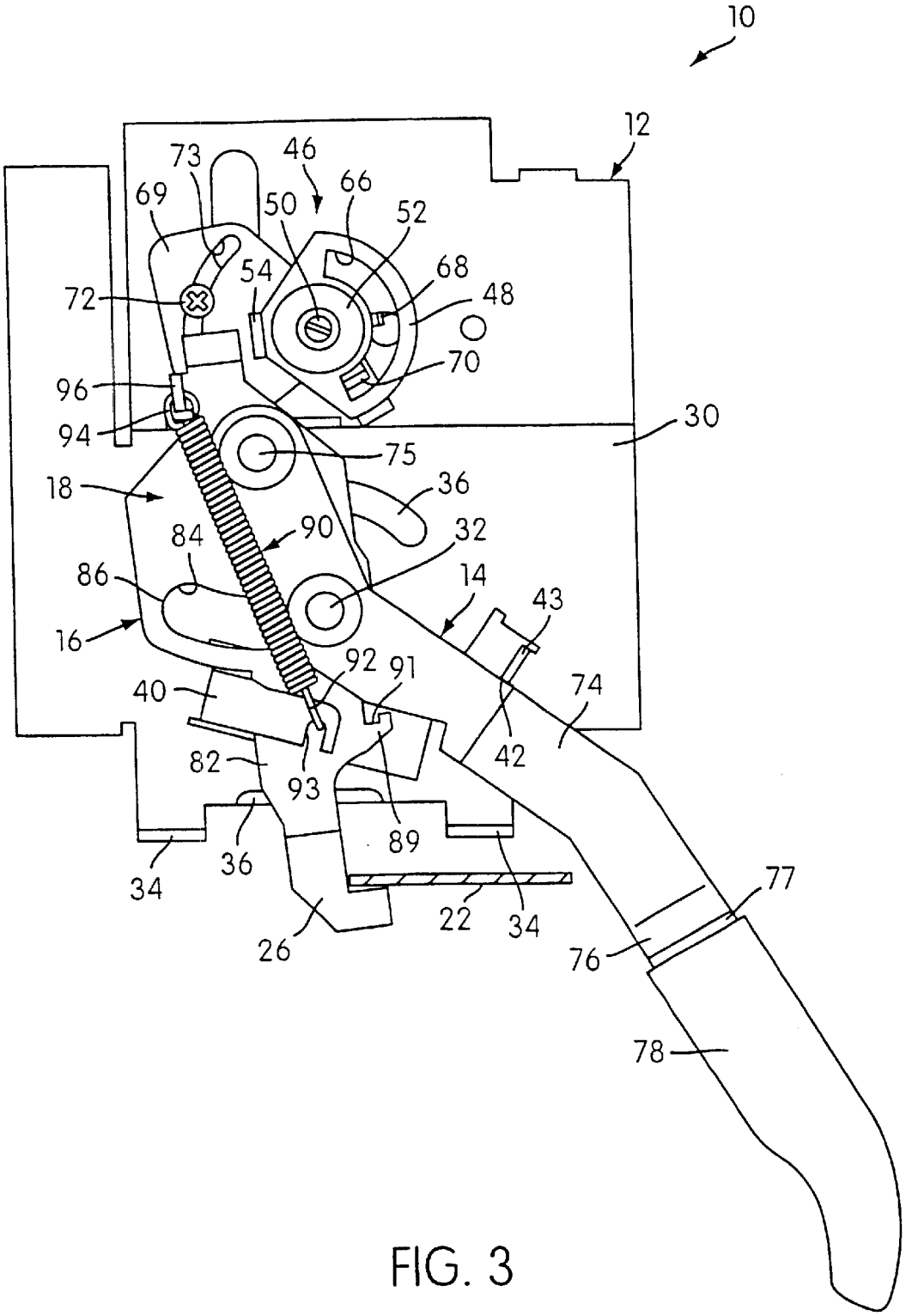
FIG. 3 is a top plan view similar to FIG. 1 showing the preferred embodiment in the door latching position.
Figure 4:
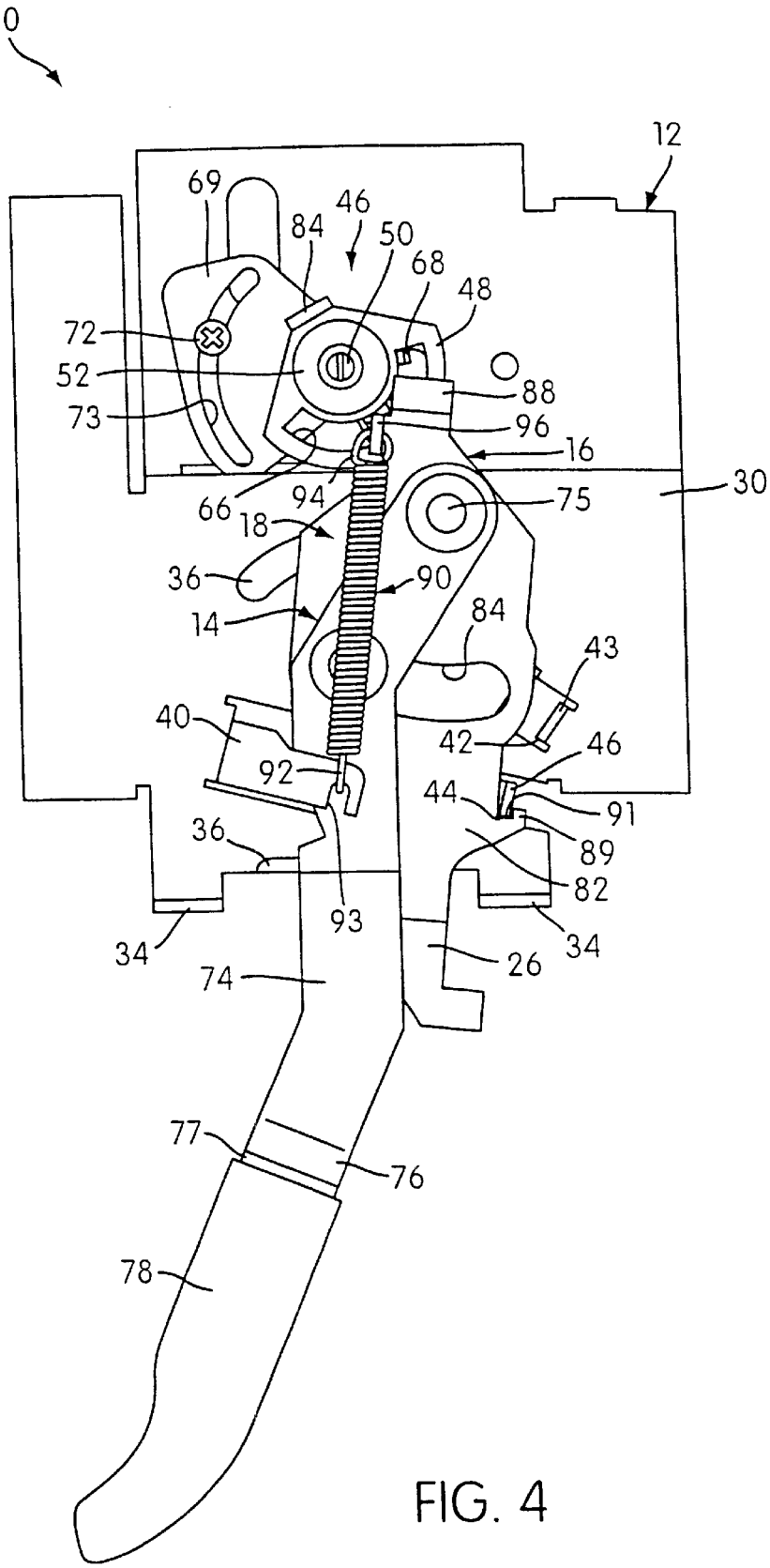
FIG. 4 is a top plan view similar to FIG. 1 showing the preferred embodiment in the stop position.
Figure 5:
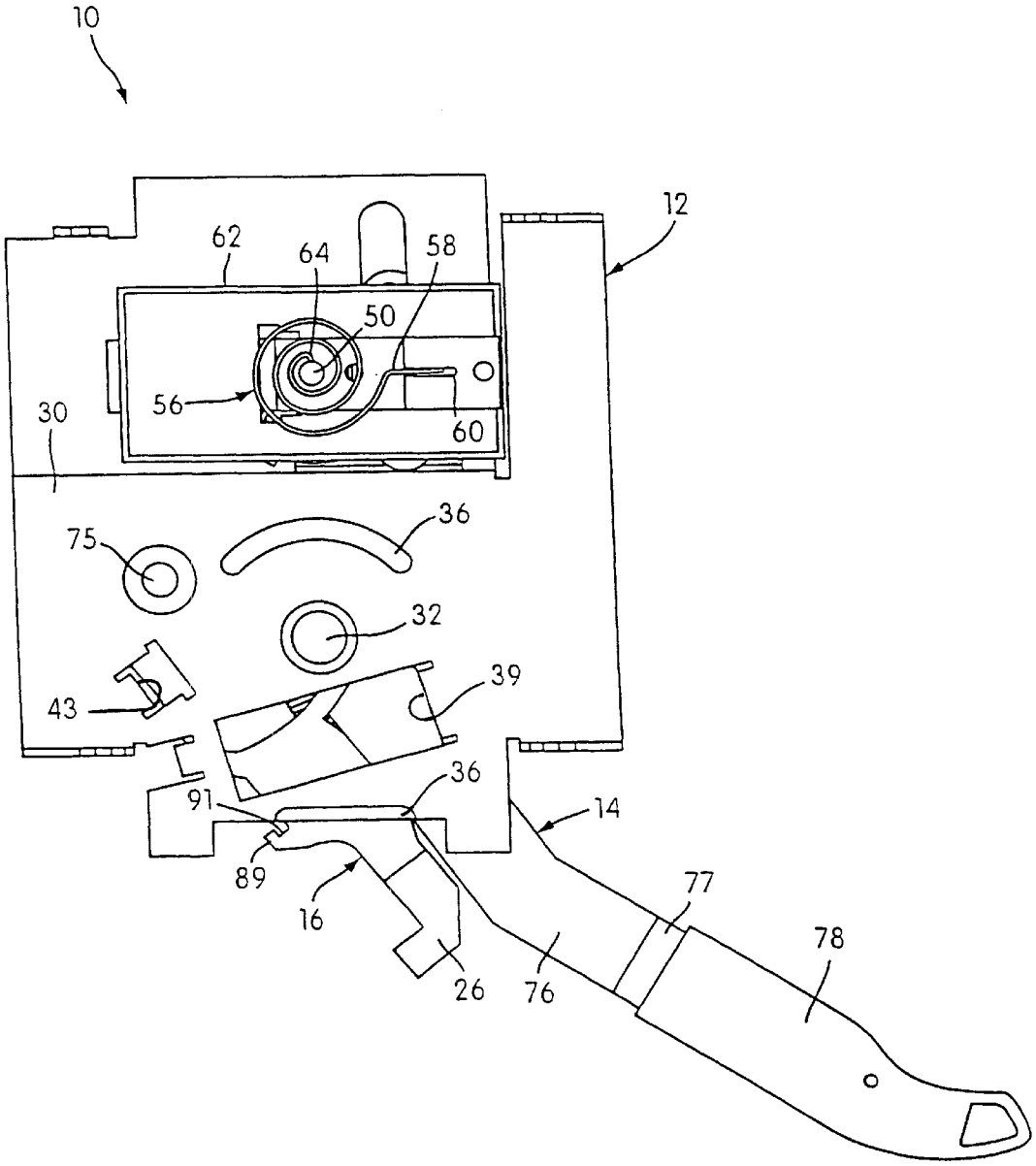
FIG. 5 is a bottom plan view similar to FIG. 1 showing the bimetallic coil of the heat activated locking assembly of the preferred embodiment in the door releasing position.

As best shown in FIGS. 1–4 and 6, the heat activated locking assembly 46 further includes a shaft 50, an arcuate disc 52 and a lock engaging stop 54. The shaft 50 extends through the heat activated locking assembly 48, which carries the upwardly protruding lock engaging stop 54 thereon and through the arcuate disc 52. The heat activated locking assembly 48 and the arcuate disc 52 are mounted to one end of the shaft 50. FIG. 5 shows an inner end 64 of a bimetallic coil 56 mounted on the other end of the shaft 50. The bimetallic coil 56 has an outer free end 58 disposed within slot 60 in a mounting housing plate 62. A drive connection is provided between the shaft 50 and the lock engaging stop 54 upon rotation of the shaft 50 by the bimetallic coil 56. The lock engaging stop 54 has an arcuate slot 66 therein in which upstanding lugs 68 and 70 are disposed. The lug 68 extends from an adjusting member 69 and the adjusting member 69 has an arcuate slot 73 therein. As best shown in FIG. 1, the lug 68 is rotatable over a limited range of adjustment by loosening an adjustment screw 72, which is slidable within the arcuate slot 73 of the adjusting member 69. This sliding action allows the lug 68 to move within the arcuate slot 66 so to limit the movement of the heat sensitive actuator 48, as shown in FIG. 2. The lug 70 integrally extends from the sheet metal frame member 30 and is fixed within the arcuate slot 66 to further limit the movement of the heat sensitive actuator 48, as shown in FIG. 3.

As best shown in FIGS. 1–6, the handle structure 14 comprises an elongated lever 74 formed of sheet metal pivotally interconnected at one end with the latching structure 16 by a pivot pin 75 and at a position spaced inwardly thereof by the pivot pin 32. The lever 74 extends beyond the pivot pin 32 to an opposite free end portion 76 having a hand grip element 78 thereon. Preferably, the hand grip element 78 receives the free end portion 76 and is welded thereto by a weld 77. It is contemplated in the broadest aspects of the invention that the free end portion 76 could be formed as an individual unit with the hand grip element 78.

Figure 6:
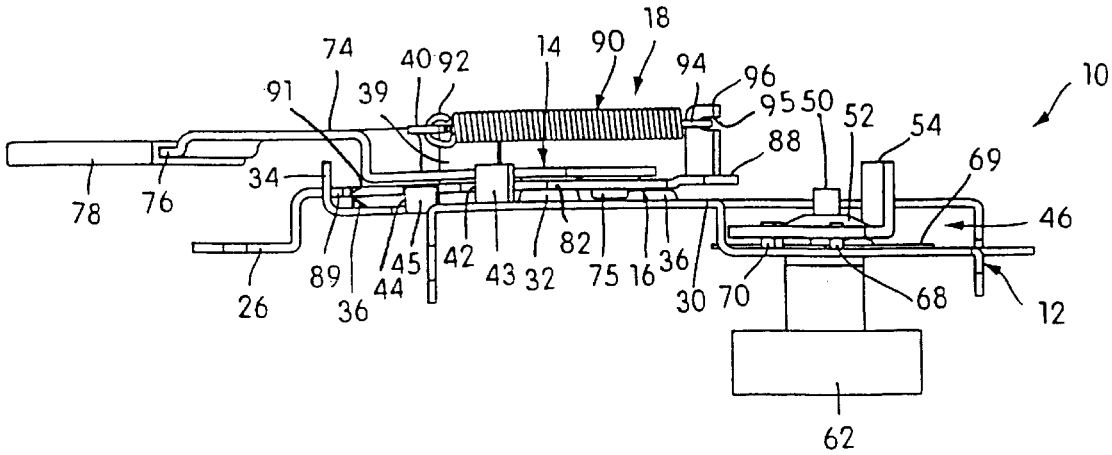
FIG. 6 is a side elevational view of the preferred embodiment in the door releasing position.

As best shown in FIG. 6, the latching structure 16 comprises a sheet metal latching member 82 disposed between the sheet metal frame member 30 and the sheet metal elongated lever 74 such that the latching member 82 moves on a different operational plane from the lever 74. As shown in FIGS. 1–4, the sheet metal latching member 82 includes an arcuate slot 84 therein. The pivot pin 32 is disposed within the arcuate slot 84 and the engagement of end 86 of the arcuate slot 84 with the pin 32 determines the inoperative position of the latching structure 16.

The sheet metal latching member 82 further includes a lock portion 88 and a stop engaging portion 89. As best shown in FIG. 3, the lock portion 88 is disposed into a locking position when the latching structure 16 is in the operative position. The heat activated locking assembly 46 is carried by the sheet metal frame member 30 and moves between a lock retaining position and a lock releasing position wherein the lock retaining position retains the lock portion 88 in the locking position, as shown in FIG. 3 and the lock releasing position allows the lock portion 88 to move out of the locking position, as shown in FIGS. 1 and 2. As best shown in FIGS. 1–3, the stop engaging portion 89 has a stop engaging surface 91 configured to engage the third stop surface 44 of the bent tab 45 when the handle structure 14 is moved into the stop position. In the stop position shown in FIG. 4, the stop engaging surface 91 engages the third stop surface 44.

Preferably, the frame member 30, the lever 74 and the latching member 82 are die-stamped from high-grade sheet steel though in their broadest aspects, may be made from injection molded resinous plastic materials, or other conventional materials previously used or usable in appliance door latch assemblies 10.

As shown in FIGS. 1–4 and 6, the overcenter spring system 18 comprises a coil spring 90, preferably in the form of a tension coil spring, having one end 92 retained within a recess 93 in the first stop structure 40. The opposite end 94 is retained within a recess 95 in a bent tab 96 on the sheet metal latching member 82. The ends 92 and 94 are disposed in opposed spaced relation with respect to the pivot pin 32 so that the coil spring 90 moves to first and second extreme positions on opposite sides of the first pivotal axis when the sheet metal lever 74 is moved between the door releasing and door latching positions, respectively.

Operation

Referring to FIGS. 1–6, the operation of the latch assembly 10 and the latching thereof to latch an appliance door 22 will be described. More specifically, FIGS. 2, 5 and 6 show the latching member 82 in an inoperative position and the lever 74 in the door releasing position. In this position, the appliance door 22 may be manually moved into the open or closed positions with the latch assembly 10 operating differently according to which position the appliance door is moved.

As previously stated, the coil spring 90 acts between the sheet metal frame member 30 and the sheet metal latching member 82 such that the direct action of the coil spring 90 is to continuously bias the latching member 82 in a counter-clockwise direction about the second pivotal axis so that it is stopped in its inoperative position wherein the end 86 of the slot 84 engages the pin 32 and prevents further counter-clockwise movement. In this stopped position, the latching member 82 and the lever 74 are essentially fixed so that the coil spring 90 now also biases the lever 74 in a counter-clockwise direction where it engages the first stop surface 39 on the first stop structure 40. The coil spring 90 is now in its first extreme position wherein it biases the latching member 82 into the inoperative position and the lever 74 in the door releasing position against the first stop surface 39.

With the appliance door 22 manually moved into a closed position as shown in FIG. 1, the lever 74 is manually moved from the door releasing position toward the door latching position. The coil spring 90 continues to bias the latching member 82 so that it moves with the lever 74 in a clockwise direction about the first pivotal axis. When the lever 74 and latching member 82 move counter-clockwise against the bias of the coil spring 90 about the first pivotal axis, the coil spring 90 moves toward a center position defined by the position where the coil spring 90 acts through the first pivotal axis.

Before the coil spring 90 reaches its center position, the latch portion 26 of the latching member 82 engages the latch receiving structure 24 of the appliance door 22, as shown in FIG. 2. After the initial engagement thereof, the arcuate movement of the latch portion 26 of the latching member 82 with the lever 74 is stopped by the latch receiving structure 24, but the bent tab 96 thereof continues to be moved by the lever 74 through the pivot pin 75 arcuately about the first pivotal axis. During this arcuate movement, the latch portion 26 moves in the general direction of the second pivotal axis, as the pivot pin 75 moves arcuately about the first pivotal axis to engage the end of the latch portion 26 with the appliance door 22 in a closed position and to finally move the pivot pin 75 to the opposite side of the first pivotal axis with respect to the position of engagement of the latch portion 26 with the latch receiving structure 24.

It will also be noted that during the aforesaid manual movement of the pivot pin 75, the bent tab 96 carries the end 94 of the coil spring 90 to an overcenter position with respect to the first pivotal axis until the manual movement of the pivot pin 75 is arrested when the lever 74 engages the second stop surface 42. The coil spring 90 is now in its second extreme position wherein it biases the latch portion 26 counter-clockwise into its operative position and acts through the latching member 82 to bias the lever 74 counter-clockwise into its door latching position against the second stop surface 42 to prevent further manual movement thereof.

Once the lever 74 is in the door latching position and the latching member 82 is in the operative position as shown in FIG. 3, the position of engagement of the latch portion 26 with the latch receiving structure 24 of the appliance door 22 and the position of the second pivotal axis with respect to the first pivotal axis is such that the application of a force on the appliance door 22 in a direction away from its closed position intensifies the engagement of the lever 74 with the second stop surface 42.

In this position, in the case of a self-cleaning oven appliance, the user may press a cleaning switch (not shown) to start the cleaning cycle involving a relatively high temperature condition inside of the oven chamber. The bimetallic coil 56 is disposed within the oven chamber and is subject to elevated temperatures causing the bimetallic coil 56 to unwind or expand. As the temperature reaches a predetermined relatively high temperature condition, the bimetallic coil 56 rotates the shaft 50 and the heat sensitive actuator 48 having the lock engaging stop 54 thereon from an unlocked position, as shown in FIG. 4, to a locked position, as shown in FIGS. 2 and 3. The lock engaging stop 54 engages the lock portion 88 of the sheet metal latching member 82 so to lock the sheet metal latching member 82 and the appliance door 22 in their respective operative and closed positions until the temperature reaches a predetermined relatively low temperature condition. In this locked position, the user may not manually move the lever 74 out of the door latching position toward the door releasing position while the high temperature condition exists in the oven chamber.

It should be understood that the operation of the latching assembly 10 with the appliance door 22 in the open position is similar for the operation with the appliance door in the closed position, except that the stop engaging portion 89 of the latching member 82 engages the third stop surface 44 since the latch receiving structure 24 is not present when the door is out of its closed position, as shown in FIG. 4 and which will now be described. As noted above, the coil spring 90 continuously biases the latching member 82 about the second pivotal axis such that when the lever 74 is moved from the door releasing position toward the stop position, the lever 74 and the sheet metal latching member 82 move counter-clockwise together about the first pivotal axis. The lever 74 and latching member 82 are moved about the first pivotal axis until the stop engaging portion 89 on the latching member 82 engages the third stop surface 44. After the lever 74 and the latching member 82 have been moved into the stop position with the appliance door 22 away from the closed position and the lever 74 is manually released, the coil spring 90 returns the lever 74 to the door releasing position and the latching member 82 to the inoperative position because of it biases the lever 74 and the latching member 82 in a clockwise direction about the first pivotal axis.

It should be noted that during all previously described movement, the lever 74 is stabilized against non-pivotal or rocking movement about its first pivot pin 32. The lever 74 is stabilized because one end thereof is pivotally interconnected with the second pivot pin 75 which is radially outwardly spaced from the first pivot pin 32. The second pivot pin 75 provides stabilization because it is mounted to the latching member 82 which, in turn, is stabilized with respect to the frame member 30 by the slotted connection beneath the lever 74 with the first pivot pin 32 and by the engagement of its lower surface with the pair of elongated raised portions 36 which are spaced on opposite sides of the first pivot pin 32.

While the principles of the invention have been made clear in the illustrative embodiments set forth above, it will be obvious to those skilled in the art to make various modifications to the structure, arrangement, proportion, elements, materials, and components used in the practice of the invention.

Any U.S. Patents or patent applications mentioned herein above and not specifically incorporated by reference are hereby incorporated into the present application by reference.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A latch assembly for manually releasably latching an appliance door in a closed position capable of being manually moved between an open position and a closed position, said latch assembly comprising:

a frame structure constructed and arranged to be fixed with respect to an appliance structure to which the appliance door is movably mounted at a position adjacent the appliance door, a handle structure connected to said frame structure for pivotal movement about a first pivotal axis between door releasing and door latching positions, a latching structure connected to said handle structure for pivotal movement with respect thereto about a second movable pivotal axis disposed in spaced relation to said first pivotal axis between an inoperative position allowing the appliance door to be manually moved between the open and closed positions thereof and an operative position latching the appliance door in the closed position thereof, and an overcenter spring system constructed and arranged to (1) bias said latching structure into the inoperative position thereof when said handle structure is in the door releasing open position thereof and to releasably retain said handle structure in the door releasing position thereof and (2) bias said latching structure into the operative position thereof when said handle structure is moved from the door releasing position thereof into the door latching position thereof with the appliance door in the closed position thereof and to releasably retain said handle structure in the door latching position thereof.

2. A latch assembly according to claim 1, wherein said latching structure includes a latch portion configured and positioned to engage a latch receiving structure of the appliance door at the end of a first portion of the movement of said handle structure from the door releasing position thereof to the door latching position thereof with the appliance door in the closed position thereof so as to cause a relative pivotal movement of said latching structure about said second pivotal axis away from the inoperative position thereof and against the bias of said overcenter spring system during the remaining portion of the movement of the handle structure from the door releasing position thereof to the door latching position thereof wherein the overcenter spring system is operable to bias the latching structure into the operative position thereof.

3. A latch assembly according to claim 2, wherein said frame structure includes a stop structure configured and positioned with respect to said latching structure such that when said handle structure is moved from the door releasing position thereof toward the door latching position thereof beyond the end of said first movement portion with the appliance door away from the closed position thereof said latching structure is carried therewith into engagement with said stop structure at a stop position to prevent further movement of said handle structure toward the door latching position thereof.

4. A latch assembly according to claim 3, wherein said overcenter spring system is constructed and arranged when said handle structure has been moved into said stop position with the appliance door away from the closed position to return said handle structure to the door releasing position thereof if manually released.

5. A latch assembly according to claim 4, wherein said overcenter spring system comprises a coil spring having opposite ends connected between said frame structure and said latching structure so as to move to first and second extreme positions on opposite sides of said first pivotal axis when said handle structure is moved between the door releasing and door latching positions thereof respectively, said coil spring (1) when in said first extreme position biasing said latching structure into the inoperative position thereof with respect to said handle structure to thereby bias the handle structure into the door releasing position as determined by the handle structure engaging a first stop surface on said frame structure and (2) when in said second extreme position biasing said latching structure into said operative position and said handle structure into said door latching position as determined by the handle structure engaging a second stop surface.

6. A latch assembly according to claim 5, wherein the position of engagement of the latch portion with the latch receiving structure of the appliance door and the position of the second pivotal axis with respect to the first pivotal axis is such that the application of a force on the door in a direction away from the closed position thereof intensifies the engagement of the handle structure with the second stop surface when said handle structure is in the door latching position thereof and said latching structure is in the operative position thereof.

7. A latch assembly according to claim 6, wherein said latching structure includes a lock portion disposed in a locking position when said latching structure is in the operative position thereof and a heat activated locking assembly is carried by said frame structure for movement between a lock retaining position retaining said lock portion in said locking position and a lock releasing position allowing said lock portion to move out of said locking position.

8. A latch assembly according to claim 7, wherein said heat activated locking assembly includes a heat sensitive actuator having a lock engaging stop constructed and arranged to (1) move into the path of movement of said lock portion when said heat sensitive actuator measures a predetermined relatively high temperature condition within the appliance and (2) move out of the path of movement of said lock portion when said heat structure actuator measures a predetermined lower temperature condition within the appliance.

9. A latch assembly according to claim 2, wherein said handle structure is moved into engagement with a stop surface on the frame structure when said handle structure is moved into the door latching position thereof, the position of engagement of said latch portion with the latch receiving structure of the appliance door and the position of the second pivotal axis with respect to the first pivotal axis is such that an application of a force on the door in the direction away from the closed position thereof intensifies the engagement of said handle structure with said stop surface.

10. A latch assembly according to claim 1, wherein said frame structure includes a sheet metal frame member having a pivot pin fixed thereto and extending outwardly therefrom on which said handle structure is pivotally mounted.

11. A latch assembly according to claim 10, wherein said handle structure comprises an elongated lever formed of sheet metal pivotally interconnected at one end with said latching structure and at a position spaced inwardly thereof with said pivot pin, said lever extending beyond said pivot pin to an opposite free end portion having a hand grip element thereon.

12. A latch assembly according to claim 11, wherein said latching structure comprising sheet metal latching member disposed between said sheet metal frame member and said sheet metal lever, said sheet metal latching member including an arcuate slot receiving said pivot pin, the engagement of one end of said arcuate slot with said pin determining the inoperative position of said latching structure.

13. A latch assembly according to claim 12, wherein said sheet metal frame member has a pair of elongated raised portions disposed on opposite sides of said pivot pin configured and positioned to be engaged by said sheet metal latching member to guide the same during movements thereof with respect to the sheet metal frame member.

14. A latch assembly according to claim 1, wherein said overcenter spring system includes a tension coil spring having one end fixed to a bent tab on said sheet metal frame member disposed in spaced relation with respect to said pivot pin and on opposite end fixed to a bent tab on the sheet metal latching member disposed in opposed spaced relation with respect to the pivot pin.

15. A latch assembly according to claim 14, wherein said latching structure includes a latch portion configured and positioned to engage a latch receiving structure of the appliance door when said latching structure is disposed in the operative position thereof and said handle structure is moved into said door latching position so that the position of engagement of said latch portion with said latch receiving structure and the position of said second pivotal axis are disposed on opposite sides of said first pivotal axis.

16. A latch assembly according to claim 1, wherein said handle structure is stabilized against non-pivotal or rocking movement about said first pivotal axis by a first pivot pin at said first axis which connects said handle structure to said frame structure and extends through a slot in said latching structure therebetween and by a second pivot pin which connects said handle structure to said latching structure which in turn is stabilized with respect to said frame structure by engagement with elongated raised portions of the frame structure on opposite sides of said first pivot pin.

* * * * *